US009995164B2

(12) United States Patent
Nishijima et al.

(10) Patent No.: US 9,995,164 B2
(45) Date of Patent: Jun. 12, 2018

(54) ROTATING FLUID MACHINE

(71) Applicant: MITSUBISHI HITACHI POWER SYSTEMS, LTD., Yokohama (JP)

(72) Inventors: Noriyo Nishijima, Tokyo (JP); Akira Endo, Tokyo (JP); Kazuyuki Yamaguchi, Tokyo (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 200 days.

(21) Appl. No.: 14/651,436

(22) PCT Filed: Dec. 13, 2012

(86) PCT No.: PCT/JP2012/082353
§ 371 (c)(1),
(2) Date: Jun. 11, 2015

(87) PCT Pub. No.: WO2014/091599
PCT Pub. Date: Jun. 19, 2014

(65) Prior Publication Data

US 2015/0369075 A1 Dec. 24, 2015

(51) Int. Cl.
*F01D 11/08* (2006.01)
*F01D 11/02* (2006.01)
(Continued)

(52) U.S. Cl.
CPC ..... *F01D 11/08* (2013.01); *F01D 1/02* (2013.01); *F01D 5/10* (2013.01); *F01D 5/20* (2013.01);
(Continued)

(58) Field of Classification Search
CPC . F01D 11/02; F01D 11/08; F01D 1/02; F01D 25/24; F01D 5/10; F01D 5/20;
(Continued)

(56) References Cited

U.S. PATENT DOCUMENTS 4,162,077 A 7/1979 Crow et al.
4,657,479 A * 4/1987 Brown ..... F01D 11/08 415/127
(Continued)

FOREIGN PATENT DOCUMENTS

DE 101 40 742 A1 6/2002
JP 3-295499 A 12/1991
(Continued)

OTHER PUBLICATIONS

International Search Report of PCT/JP2012/082353.
(Continued)

*Primary Examiner* — William McCalister
(74) *Attorney, Agent, or Firm* — Mattingly & Malur, PC

(57) ABSTRACT

Provided is a rotating fluid machine capable of holding down a decrease rate of a circumferential velocity of a leakage fluid in an interspatial flow passage and thereby controlling an unstable fluid force. A steam turbine includes: an interspatial flow passage 15 formed between an outer circumferential surface of a rotor blade cover 6 and an inner circumferential surface of a grooved section 14 in a casing 1; annular sealing fins 17A to 17D spatially arranged in a direction of a rotor axis, at a side of the rotor blade cover 6 in the interspatial flow passage 15; and a friction enhancement portion (more specifically, rough surfaces 19A to 19E) disposed over the whole circumference on the side of the rotor blade cover 6 in the interspatial flow passage 15.

6 Claims, 13 Drawing Sheets

(51) Int. Cl.

| | |
|---|---|
| ***F01D 5/20*** | (2006.01) |
| ***F01D 1/02*** | (2006.01) |
| ***F01D 9/04*** | (2006.01) |
| ***F01D 25/24*** | (2006.01) |
| ***F04D 3/00*** | (2006.01) |
| ***F04D 19/00*** | (2006.01) |
| ***F04D 29/08*** | (2006.01) |
| ***F04D 29/18*** | (2006.01) |
| ***F04D 29/32*** | (2006.01) |
| ***F04D 29/54*** | (2006.01) |
| ***F01D 5/22*** | (2006.01) |
| ***F01D 5/10*** | (2006.01) |

(52) U.S. Cl.
CPC ..... *F01D 5/225* (2013.01); *F01D 9/041* (2013.01); *F01D 11/02* (2013.01); *F01D 25/24* (2013.01); *F04D 3/00* (2013.01); *F04D 19/007* (2013.01); *F04D 29/08* (2013.01); *F04D 29/181* (2013.01); *F04D 29/32* (2013.01); *F04D 29/54* (2013.01); *F05D 2220/31* (2013.01); *F05D 2220/32* (2013.01); *F05D 2240/55* (2013.01)

(58) Field of Classification Search
CPC ..... F01D 5/225; F01D 9/041; F04D 19/007; F04D 19/181; F04D 29/08; F04D 29/32; F04D 29/54; F04D 3/00; F05D 2220/31; F05D 2220/32; F05D 2240/55
See application file for complete search history.

(56) References Cited

U.S. PATENT DOCUMENTS

| | | | | | |
|---|---|---|---|---|---|
| 4,767,266 | A * | 8/1988 | Holz | F01D 11/08 | 277/412 |
| 5,042,823 | A * | 8/1991 | MacKay | F01D 11/02 | 277/355 |
| 5,071,138 | A * | 12/1991 | MacKay | F01D 11/02 | 277/303 |
| 5,676,521 | A * | 10/1997 | Haynes | F01D 25/24 | 415/169.1 |
| 2004/0036227 | A1* | 2/2004 | Sarshar | F01D 11/02 | 277/355 |
| 2004/0046323 | A1* | 3/2004 | McCutchan | F01D 11/02 | 277/409 |
| 2008/0114339 | A1* | 5/2008 | McBride | F04D 3/00 | 604/891.1 |
| 2009/0142187 | A1* | 6/2009 | Narita | F01D 11/001 | 415/173.1 |
| 2010/0278645 | A1* | 11/2010 | Narita | F01D 1/02 | 415/230 |
| 2012/0007317 | A1* | 1/2012 | Beeck | F01D 11/02 | 277/411 |
| 2012/0063904 | A1* | 3/2012 | Roussille | F01D 5/225 | 416/190 |
| 2015/0001812 | A1* | 1/2015 | Stefanis | F01D 11/02 | 277/412 |

FOREIGN PATENT DOCUMENTS

| | | | |
|---|---|---|---|
| JP | 10-8993 | A | 1/1998 |
| JP | 2006-52808 | A | 2/2006 |
| JP | 2006-104952 | A | 4/2006 |
| JP | 2006-291967 | A | 10/2006 |
| JP | 2008-196522 | A | 8/2008 |

OTHER PUBLICATIONS

Extended European Search Report received in corresponding European Application No. 12889846.7 dated Nov. 3, 2016.
International Preliminary Report on Patentability received in corresponding International Application No. PCT/JP2012/082353 dated Jun. 25, 2015.

* cited by examiner

ROTATING FLUID MACHINE

TECHNICAL FIELD

The present invention relates generally to steam turbines, gas turbines, and other rotating fluid machines, and more particularly, to rotating fluid machines having an interspatial flow passage formed between an outer circumferential surface of a rotating section and an inner circumferential surface of a stationary section.

BACKGROUND ART

In general, steam turbines that are one form of rotating fluid machine include a casing, a rotor rotatably disposed inside the casing, a stator vane cascade disposed at an inner circumferential side of the casing, and a rotor blade cascade provided at an outer circumferential side of the rotor and disposed at an axial downstream side of the rotor with respect to the stator vane cascade. When a working fluid in a main flow passage is passed through the stator vane cascade (more specifically, between stator vanes), internal energy (in other words, pressure energy or the like) of the working fluid is converted into kinetic energy (in other words, velocity energy). That is to say, the working fluid increases in velocity. Thereafter, while the working fluid passes through the rotor blade cascade (more specifically, between rotor blades), the kinetic energy of the working fluid is converted into rotational energy of the rotor. This means that the working fluid acts upon the rotor blade cascade to rotate the rotor.

In some kinds of steam turbines, an annular rotor blade cover is provided at an outer circumferential side of the rotor blade cascade and an annularly grooved section with the rotor blade cover placed therein is formed at the inner circumferential side of the casing. In such a turbine structure, an interspatial flow passage is formed between an outer circumferential surface of the rotor blade cover and an inner circumferential surface of the grooved section in the casing facing the outer circumferential surface. Although a large portion of the working fluid flows along the main flow passage and passes through the rotor blade cascade, a portion of the working fluid is likely to leak as a leakage fluid from the main flow passage into the interspatial flow passage, thus fail to pass through the rotor blade cascade, and consequently make practically no contribution to rotor rotation.

Interspatial flow passages typically have a labyrinth seal to prevent such a leakage flow as described above and enhance turbine efficiency. The labyrinth seal includes a plurality of stages of sealing fins on the rotor side or the casing side, the fins being spatially arranged in an axial direction of the rotor. A seal gap of the labyrinth seal (i.e., a dimension of a clearance reducing portion defined between a distal end of each sealing fin and an area facing the distal end) is limited for purposes such as accommodating any deformation and displacement of members due to thermal expansion or thrust loading. Even when the labyrinth seal is disposed, therefore, a leakage flow from the main flow passage into the interspatial flow passage occurs, which then results in unstable vibration. The fluid force component causing the unstable vibration will be described below with reference to FIG. 14.

FIG. 14 is a sectional view taken along a radial direction of a rotating section 100 to schematically shows an interspatial flow passage 104, the interspatial flow passage 104 being formed between an outer circumferential surface 101 of the rotating section 100 (the outer circumferential surface 101 is equivalent to the outer circumferential surface of the rotor blade cover discussed above) and an inner circumferential surface 103 of a stationary section 102 (the inner circumferential surface 103 is equivalent to the inner circumferential surface of the grooved section in the casing discussed above). The rotating section 100 in FIG. 14 is rotating in a direction indicated by arrow A. In addition, for reasons such as a manufacturing tolerance, gravity, or vibration during rotation, the rotating section 100 is located in an eccentric position denoted by a solid line in FIG. 14, not in a concentric position denoted by a dotted line in the figure, with respect to the stationary section 102. In other words, the rotating section 100 has its center offset from that of the stationary section 102 by the amount of eccentricity, 'e'. This offset causes the interspatial flow passage 104 to assume circumferential nonuniformity of its lateral dimension D (in other words, its radial dimension between the outer circumferential surface 101 of the rotating section 100 and the inner circumferential surface 103 of the stationary section 102).

A leakage fluid that has flown from a main flow passage into the interspatial flow passage 104 is flowing, for example, in a helical form as indicated by arrow B in FIG. 15. This helical flow can be broken down into an axial velocity component and a circumferential velocity component. The circumferential velocity component and the deviation of the lateral dimension D of the interspatial flow passage 104 cause a nonuniform circumferential pressure distribution P of the interspatial flow passage 104, as shown in FIG. 14. A force that the pressure distribution P exerts upon the rotating section 100 can be resolved into a force Fx applied in an opposite direction (an upward direction in FIG. 14) with respect to a decentering direction and a force Fy (hereinafter referred to as the unstable fluid force) that is applied vertically (a rightward direction in FIG. 14) with respect to the decentering direction. The unstable fluid force Fy causes whirling of the rotating section 100. The unstable vibration of the rotating section 100 occurs when the unstable fluid force Fy is greater than a damping force of the rotating section 100.

A relational formula that uses the unstable fluid force Fy and the amount of eccentricity, 'e', is represented as following formula (1). Formula (1) can be obtained by supposing that the rotating section 100 whirls at a speed and that its whirling orbit is a true circle, and omitting an inertial term. In formula (1), 'k' denotes a spring constant of the fluid force, 'C' a damping coefficient, and 'C*Ω' a damping effect of the fluid force associated with whirling.

$$Fy/e=k-C*\Omega \quad (1)$$

To stabilize the whirling of the rotating section 100 and cause no unstable vibration, formula (1) needs to have a negative value on its right-hand side. Realistically, however, another stabilization element such as a bearing is present. The right-side value of formula (1) does not need to be negative but it is desirable that this value be small. That is to say, it is desirable that the spring constant 'k' of the fluid force be small and that the damping coefficient C be large.

As described in Patent Document 1, for example, a conventional technique for reducing the foregoing unstable fluid force is known to reduce a circumferential velocity of a leakage fluid during a flow of the leakage fluid from a main flow passage into an interspatial flow passage. In the conventional technique described in Patent Document 1, for example, a frictional resistance portion is disposed on a side surface of a grooved section of a casing in an interspatial inlet located at an upstream side of the interspatial flow passage.

PRIOR ART DOCUMENTS

Patent Documents

Patent Document 1: JP-2006-104952-A

SUMMARY OF THE INVENTION

Problems to be Solved by the Invention

The conventional technique controls the unstable fluid force by reducing the circumferential velocity of the leakage fluid during the flow of the leakage fluid from the main flow passage into the interspatial flow passage. The inventors of the present application, however, have found that the unstable fluid force can be lowered from a different perspective. The following describes this in detail.

The leakage fluid that has flown from the main flow passage into the interspatial flow passage has the circumferential velocity component. As shown in FIG. 16, the leakage fluid that has flown into the interspatial flow passage 104 undergoes a circumferential shear force C1 from the inner circumferential surface 103 (stationary wall) of the stationary section 102, the shear force C1 working to reduce magnitude of the circumferential velocity component B1. At the same time, however, the leakage fluid also undergoes a circumferential shear force C2 from the outer circumferential surface 101 (rotating wall) of the rotating section 100, the shear force C2 working to increase or maintain the magnitude of the circumferential velocity component B1. For example, if the circumferential shear force C1 from the stationary wall and the circumferential shear force C2 from the rotating wall are equal, then as the leakage fluid spirally flows through the interspatial flow passage 104, the circumferential velocity of the leakage fluid will decrease to be asymptotically equivalent to half a value of a speed U at which the rotating section 100 is rotating, as shown with a dotted line in FIG. 3 described later. The inventors of the present application have found that as the velocity of the leakage fluid decreases, there occurs a pressure gradient (more specifically, the pressure gradient where pressure increases in the direction that the velocity of the leakage fluid decreases) and that the particular pressure gradient is a factor of the increase in the magnitude of the unstable fluid force. The present inventors have further found that if the circumferential shear force C2 from the rotating wall is enhanced, this enables a decrease rate of the circumferential velocity of the leakage fluid to be smaller and this acts to suppress the pressure gradient and hence the unstable fluid force. Holding down the decrease rate of the circumferential velocity of the leakage fluid, however, acts to augment the circumferential velocity itself, which in turn increases the unstable fluid force as well. For this reason, as in a case that the interspatial flow passage is relatively short, the enhancement of the circumferential shear force C2 can be applied only when the action of controlling the unstable fluid force is greater than the action of increasing the unstable fluid force.

An object of the present invention is to provide a rotating fluid machine capable of holding down a decrease rate of a circumferential velocity of a leakage fluid in an interspatial flow passage and thereby controlling an unstable fluid force.

Means for Solving the Problem

A rotating fluid machine according to an aspect of the present invention, intended to achieve the above object, includes: an interspatial flow passage formed between an outer circumferential surface of a rotating section and an inner circumferential surface of a stationary section; at least three stages of annular sealing fins arranged at the rotating section side or stationary section side in the interspatial flow passage and spatially arranged in a direction of a rotational axis; and a friction enhancement portion disposed on the rotating section side in the interspatial flow passage so as to extend entirely in a circumferential direction of the rotating section.

In the present invention of the above configuration, the friction enhancement portion, provided on the rotating section side in the interspatial flow passage so as to extend entirely in a circumferential direction of the rotating section, enhances a circumferential shear force applied from the rotating section side. Thus a decrease rate of a circumferential velocity of a leakage fluid in the interspatial flow passage can be held down, which in turn enables suppression of a pressure gradient occurring as the velocity of the leakage fluid decreases, and hence, control of an unstable fluid force.

Effects of the Invention

In the present invention, the decrease rate of the circumferential velocity of the leakage fluid in the interspatial flow passage can be held down, whereby the unstable fluid force can then be controlled.

MODES FOR CARRYING OUT THE INVENTION

Hereunder, embodiments of the present invention as applied to a steam turbine will be described with reference to the accompanying drawings.

Figure 1:
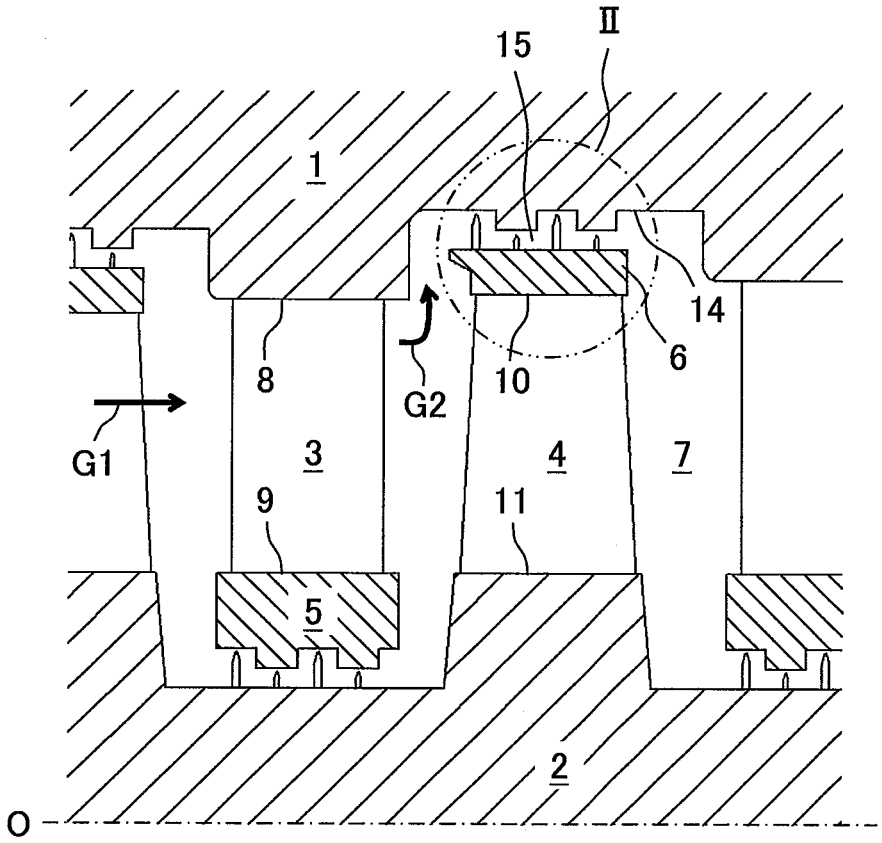
FIG. 1 is a sectional view taken along an axial direction of a rotor to schematically show a partial structure of a steam turbine in a first embodiment of the present invention.
Figure 2:
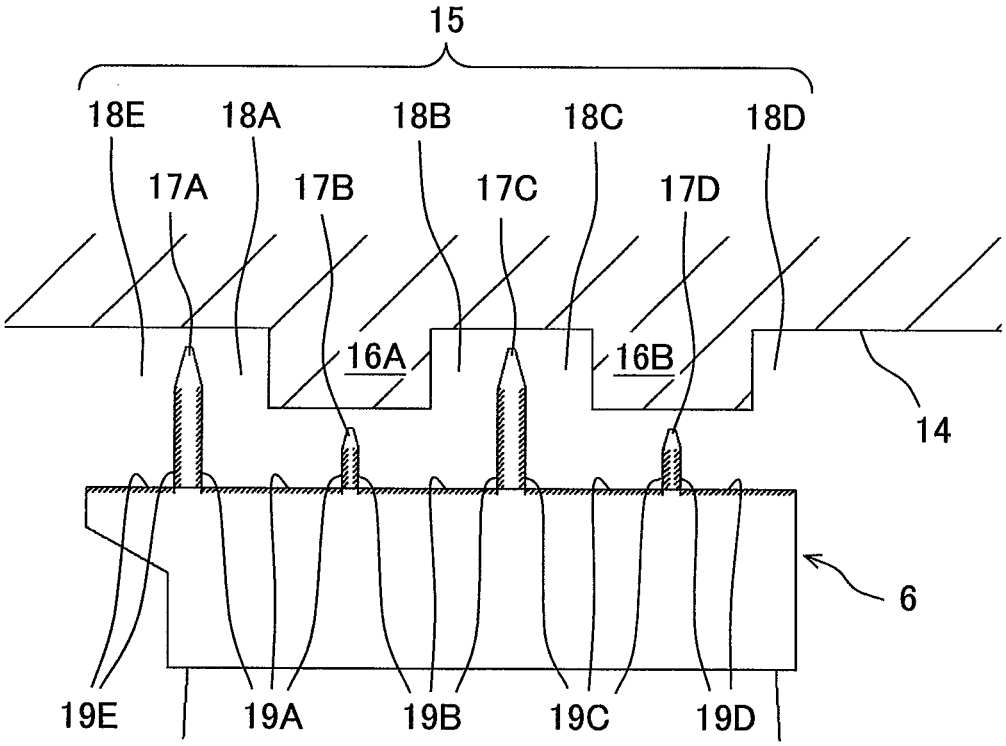
FIG. 2 is a partially enlarged sectional view of section II shown in FIG. 1, the sectional view illustrating a detailed structure of an interspatial flow passage in the first embodiment of the present invention.

FIG. 1 is a sectional view taken along an axial direction of a rotor to schematically show a partial structure (stage structure) of a steam turbine in a first embodiment of the present invention. FIG. 2 is a partially enlarged sectional view of section II shown in FIG. 1, the sectional view illustrating a detailed structure of an interspatial flow passage.

The steam turbine in FIGS. 1 and 2 includes a casing 1 of a substantially cylindrical shape and a rotor 2 rotatably disposed inside the casing 1. On an inner circumferential side of the casing 1, a stator blade cascade 3 is disposed (more specifically, a plurality of stator vanes arranged in a circumferential direction of the casing). On an outer circumferential side of the rotor 2, a rotor blade cascade 4 is disposed (more specifically, a plurality of rotor blades arranged in a circumferential direction of the rotor). An annular stator vane cover 5 is disposed on an inner circumferential side of the stator vane cascade 3 (in other words, near distal ends of the stator vanes), and an annular rotor blade cover 6 is disposed on an outer circumferential side of the rotor blade cascade 4 (in other words, near distal ends of the rotor blades).

A main flow passage 7 for steam (a working fluid) includes, for example, a flow passage formed between an inner circumferential surface 8 of the casing 1 and an outer circumferential surface 9 of the stator vane cover 5 (more specifically, between the stator vanes) and a flow passage formed between an inner circumferential surface 10 of the rotor blade cover 6 and an outer circumferential surface 11 of the rotor 2 (more specifically, between the rotor blades). The rotor blade cascade 4 is disposed at an axial downstream side (the right side in FIG. 1) of the rotor with respect to the stator vane cascade 3. A combination of the stator vane cascade 3 and the rotor blade cascade 4 constitute one stage. Although only one stage is shown in FIG. 1 for sake of simplicity, a plurality of stages are typically disposed in the axial direction of the rotor to efficiently recover internal energy of the steam.

The steam that has been generated by, for example, a boiler, is introduced into the main flow passage 7 of the steam turbine. The steam is then flowing in a direction indicated by arrow G1 in FIG. 1. When the steam in the main flow passage 7 is passed through the stator vane cascade 3, the internal energy (in other words, pressure energy or the like) of the steam is converted into kinetic energy (in other words, velocity energy). That is to say, velocity of the steam increases. After the energy conversion, when the steam is passed through the rotor blade cascade, the kinetic energy of the steam is converted into rotational energy of the rotor 2. This means that the steam acts upon the rotor blades to rotate the rotor 2 around its central axis O.

An annularly grooved section 14 with the rotor blade cover 6 placed therein is formed on the inner circumferential side of the casing 1. Accordingly an interspatial flow passage 15 is formed between an outer circumferential surface of the rotor blade cover 6 and an inner circumferential surface of the grooved section 14 in the casing 1 facing the outer circumferential surface of the rotor blade cover 6. Although a large portion of the steam flows along the main flow passage 7 and passes through the rotor blade cascade 4, as indicated by arrow G2 in FIG. 1 a portion of the steam is likely to leak from the main flow passage 7 into the interspatial flow passage 15, thus fail to pass through the rotor blade cascade 4, and consequently make practically no contribution to rotor rotation. In the interspatial flow passage 15, a labyrinth seal is disposed to prevent such a leakage flow.

The labyrinth seal in the present embodiment includes two annularly steps, 16A and 16B, on an inner circumferential side of the grooved section 14 in the casing 1. On the outer circumferential surface of the rotor blade cover 6, four stages of sealing fins, 17A to 17D, are spatially arranged in the axial direction of the rotor. Although the sealing fins 17A to 17D may be formed integrally with the rotor blade cover 6, the sealing fins may instead be formed separately from the rotor blade cover. In addition, the sealing fins may be fixedly buried in a groove formed on an outer circumferential side of the rotor blade cover 6.

The sealing fins 17A to 17D extend from the outer circumferential surface of the rotor blade cover 6 toward the inner circumferential surface of the grooved section 14 in the casing 1. The sealing fins 17B and 17D respectively extend toward the steps 16A and 16B, and are therefore shorter than the sealing fins 17A and 17C. An independent clearance reducing portion is formed between a distal end of each of the sealing fins 17A to 17D and the inner circumferential surface of the grooved section 14 so as to perform a sealing function.

In addition, a seal-divided space 18A is defined by the sealing fin 17A of the first stage and the sealing fin 17B of the second stage, both as counted from the upstream side. Likewise, a seal-divided space 18B is defined by the sealing fin 17B of the second stage and the sealing fin 17C of the third stage; a seal-divided space 18C is defined by the sealing fin 17C of the third stage and the sealing fin 17D of the fourth stage; a seal-divided space 18D is defined downstream of the sealing fin 17D of the fourth stage; and a seal-divided space 18E is defined upstream of the sealing fin 17A of the first stage. The seal-divided spaces 18A to 18E constitute the interspatial flow passage 15.

The present embodiment has an outstanding feature that a rotational friction enhancement portion is provided at the rotating section side in the interspatial flow passage 15 overall so as to extend entirely in a circumferential direction of the rotating section. More specifically, in the seal-divided space 18A, a rough surface 19A is formed in an entire circumferential direction on each of the outer circumferential surface of the rotor blade cover 6, a downstream side surface of the sealing fin 17A, and an upstream side surface of the sealing fin 17B. Additionally, in the seal-divided space 18B, a rough surface 19B is formed in the entire circumferential direction on each of the outer circumferential surface of the rotor blade cover 6, a downstream side surface of the sealing fin 17B, and an upstream side surface of the sealing fin 17C. In the seal-divided space 18C, a rough surface 19C is formed in the entire circumferential direction on each of the outer circumferential surface of the rotor blade cover 6, a downstream side surface of the sealing fin 17C, and an upstream side surface of the sealing fin 17D. In the seal-divided space 18D, a rough surface 19D is formed in the entire circumferential direction on each of the outer circumferential surface of the rotor blade cover 6 and a downstream side surface of the sealing fin 17D. In the seal-divided space 18E, a rough surface 19E is formed in the entire circumferential direction on each of the outer circumferential surface of the rotor blade cover 6 and an upstream side surface of the sealing fin 17A. The rough surfaces 19A to 19E constitute the rotational friction enhancement portion.

The rough surfaces 19A to 19E are formed by, for example, blast machining to ensure that they are rougher than the inner circumferential surface of the grooved section 14 in the casing 1, and more specifically, that their arithmetic mean surface roughness (Ra) becomes a predetermined value falling within a range of 50-200 μm. In the blast machining, a projection material of special steel particles controlled to have a predetermined particle size falling within a range of 50-200 μm is projected toward, and caused to impinge upon, a target surface. These particles of the special steel have the same degree of hardness as, or greater hardness than, the rotor blade cover 6, and can be reused. Accordingly operational cost of the projection material can be reduced. In the present embodiment, the distal ends of the sealing fins 17A to 17D are not machined. This is because the machining of the distal ends itself is challenging and makes it difficult to dimensionally control the clearance reducing portion. Yet another reason is that whether the distal ends of the sealing fins 17A to 17D are machined has insignificant impacts upon the advantageous effects of the present invention.

Figure 3:
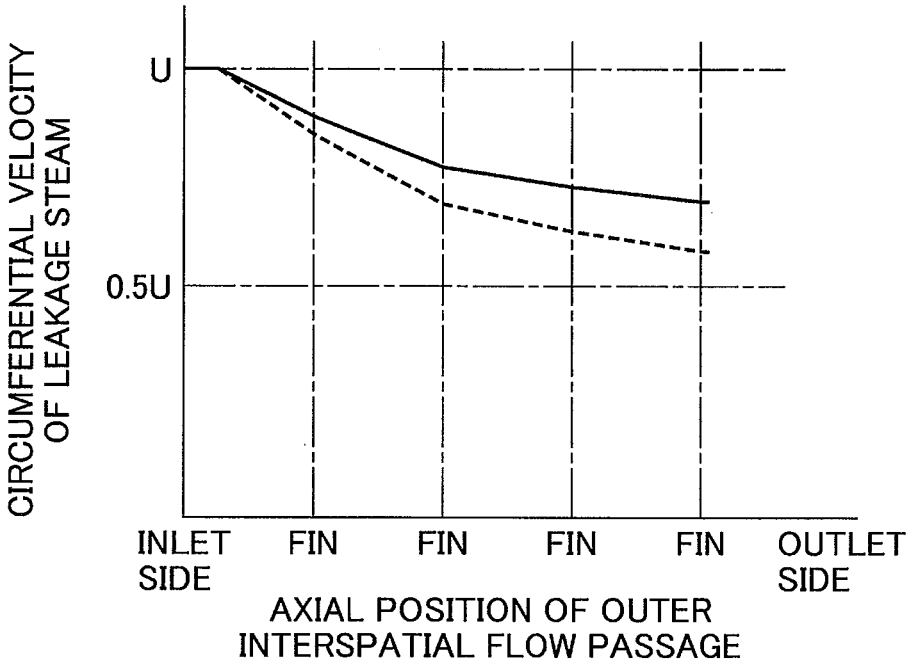
FIG. 3 is a diagram that schematically represents changes in circumferential velocities of leakage steam in the first embodiment of the present invention and in a conventional technique.

Operational advantages of the present embodiment will be described below with reference to FIG. 3. FIG. 3 is a diagram that schematically represents changes in circumferential velocities of leakage steam in the present embodiment and in prior art. A horizontal axis in FIG. 3 denotes an axial position of the interspatial flow passage 15, and a vertical axis in the figure denotes the circumferential velocity of the leakage steam.

The circumferential velocity of the leakage steam flowing from the main flow passage 15 (more accurately, the downstream side of the stator blade cascade 3) into the interspatial flow passage 15 is substantially of the same level as a whirling speed U of the rotor blade cover 6, as shown in FIG. 3. Here, the leakage steam that has flown into the interspatial flow passage 15 undergoes a circumferential shear force C1 from the inner circumferential surface (stationary wall) of the grooved section 14 in the casing 1, the shear force C1 reducing magnitude of a circumferential velocity component. At the same time, the leakage steam also undergoes a circumferential shear force C2 from the outer circumferential surface (rotating wall) of the rotor blade cover 6, the shear force C2 increasing or maintaining the magnitude of the circumferential velocity component. In such a case as with the prior art in which, for example, the circumferential shear force C1 from the stationary wall and the circumferential shear force C2 from the rotating wall become equal (in other words, a rotational friction enhancement portion is not provided at the rotating section side), as the leakage steam spirally flows through the interspatial flow passage 15, the circumferential velocity of the leakage steam decreases to be asymptotically equivalent to half a value of a speed at which the rotor rotates, as shown with a dotted line in FIG. 3. As the velocity of the leakage steam decreases, there occurs a pressure gradient (more specifically, the pressure gradient where a pressure increases in the direction that the velocity of the leakage steam decreases), and this pressure gradient increases the magnitude of an unstable fluid force.

In contrast to this, in the present embodiment, the friction enhancement portion (more accurately, the rough surfaces 19A to 19E), provided at the rotating section side in the interspatial flow passage 15 overall so as to extend entirely in a circumferential direction of the rotating section, enhances the circumferential shear force C2 from the rotating section side. Thus as shown by a solid line in FIG. 3, a decrease rate of the circumferential velocity of the leakage steam in the interspatial flow passage 15 can be held down. This enables suppression of the pressure gradient occurring as the velocity of the leakage steam decreases, and hence, control of the unstable fluid force. Holding down the decrease rate of the circumferential velocity of the leakage steam, however, acts to augment the circumferential velocity itself, which in turn increases the unstable fluid force as well. For this reason, in such a case that the interspatial flow passage is relatively short, the enhancement of the circumferential shear force C2 can only be applied when the action of controlling the unstable fluid force is greater than the action of increasing the unstable fluid force.

Since the fact that the friction enhancement portion extends entirely in the circumferential direction of the rotating section does not cause a circumferential flow disturbance, unlike a case that, for example, a friction enhancement portion is partly provided in the circumferential direction. The unstable fluid force can likewise be controlled in such terms.

Fluid analyses that the present inventors conducted for confirming the advantageous effects of the present embodiment will now be described. An interspatial flow passage model substantially of the same structure as that of the interspatial flow passage 15 in the embodiment was employed. The analyses were conducted under conditions of 11.82 MPa in pressure of interspatial flow passage inlet, 708 K in temperature of the same, 190 m/s in circumferential velocity of the same, 10.42 MPa in pressure of interspatial flow passage outlet, 55 mm in interspatial flow passage length, and 0.8 mm in the dimension of the clearance reducing portion. In addition, the surface roughness of the stationary section side that is equivalent to the surface roughness of the inner circumferential surface of the grooved section 14 in the casing 1 was taken as zero, and the surface roughness of the rotating section side that is equivalent to the surface roughness of the rough surfaces 19A to 19E was changed within a range of 0-200 μm with respect to the above reference. Furthermore, during the analyses, the rotating section and the stationary section were made eccentric relative to each other's center, and the spring constant 'k' earlier shown in formula (1) was calculated.

Figure 4:
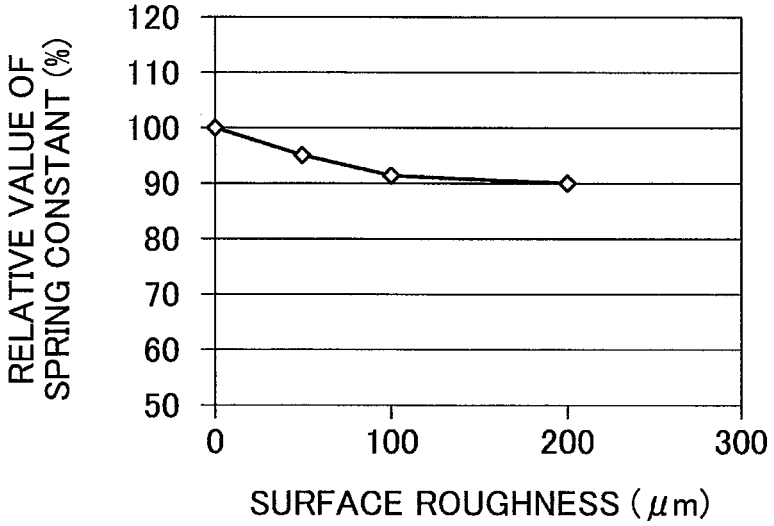
FIG. 4 is a diagram for describing advantageous effects of the first embodiment of the present invention, the diagram representing a relationship between surface roughness of a rotating section side of the interspatial flow passage and a spring constant, the relationship being derived as fluid analytical results.

FIG. 4 represents a relationship between surface roughness of the rotating section side of the interspatial flow passage and the spring constant, the relationship being obtained as a fluid analytical result. In FIG. 4, changes in the surface roughness of the rotating section side are plotted along a horizontal axis; changes in a relative value of the spring constant, expressed for a reference spring constant of 100% in which the surface roughness of the rotating section side was taken as zero (in other words, the case that the rough surfaces 19A to 19E are not formed as in the prior art), are plotted along a vertical axis.

It can be appreciated from the fluid analytical result in FIG. 4 that the spring constant decreases as the surface roughness of the rough surfaces 19A to 19E is increased so as to be greater than that of the inner circumferential surface of the grooved section 14 in the casing 1. More specifically, when the surface roughness of the rough surfaces 19A to 19E is increased to 50 μm, the spring constant decreases by nearly 5%. When the surface roughness of the rough surfaces 19A to 19E is further increased to 100 μm, the spring constant decreases by nearly 8%. Furthermore, when the surface roughness of the rough surfaces 19A to 19E is further increased to 200 μm, the spring constant decreases by nearly 10%. These results indicate that the unstable fluid force can be controlled.

A second embodiment of the present invention will now be described with FIG. 5.

Figure 5:
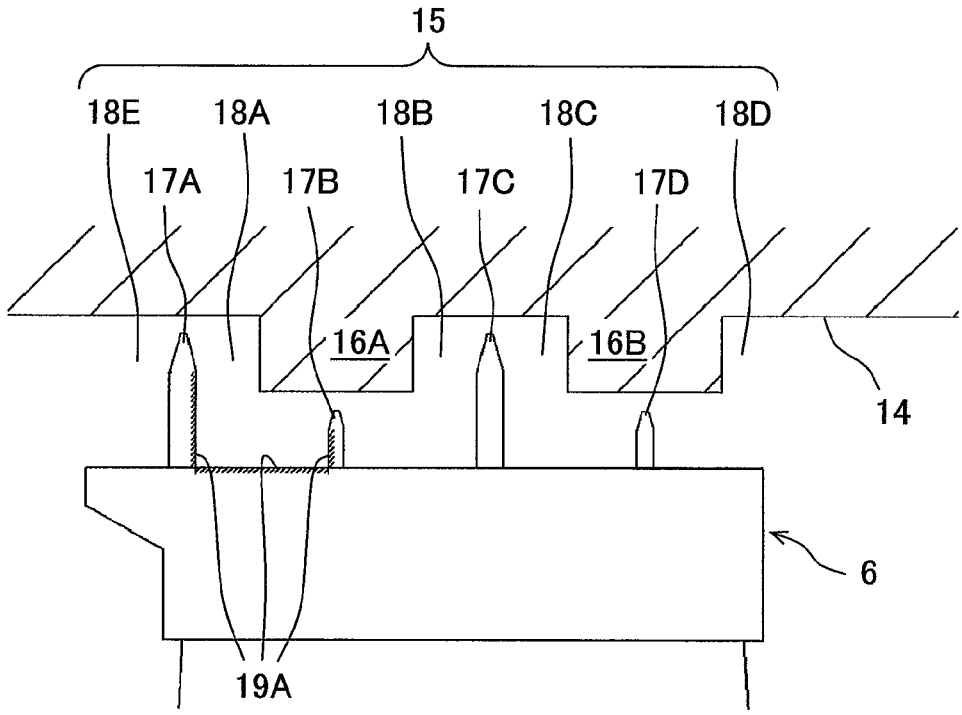
FIG. 5 is a partially enlarged sectional view illustrating a detailed structure of an interspatial flow passage in a second embodiment of the present invention.

FIG. 5 is a partially enlarged sectional view illustrating a detailed structure of an interspatial flow passage in the present embodiment. Elements in the present embodiment that are equivalent to those of the first embodiment are each assigned the same reference number, and description of these elements may be omitted where appropriate.

In the present embodiment, while the rough surface 19A in the seal-divided space 18A is formed, the rough surface 19B in the seal-divided space 18B, the rough surface 19C in the seal-divided space 18C, the rough surface 19D in the seal-divided space 18D, and the rough surface 19E in the seal-divided space 18E are not present.

In the second embodiment having the above configuration, as in the first embodiment, the decrease rate of the circumferential velocity of the leakage steam in the interspatial flow passage 15 can be held down and unstable fluid force can also be controlled thereby. These suppression effects, however, are insignificant in comparison with those of the first embodiment. In addition, compared to a case in which the rough surface 19B in the seal-divided space 18B, the rough surface 19C in the seal-divided space 18C, the rough surface 19D in the seal-divided space 18D, or the rough surface 19E in the seal-divided space 18E is formed independently, the above suppression effects are significant as will be detailed later.

Furthermore, in the present embodiment, since a machining zone is smaller than that required in the first embodiment, a machining time can be correspondingly reduced.

A third embodiment of the present invention will now be described with FIG. 6.

Figure 6:
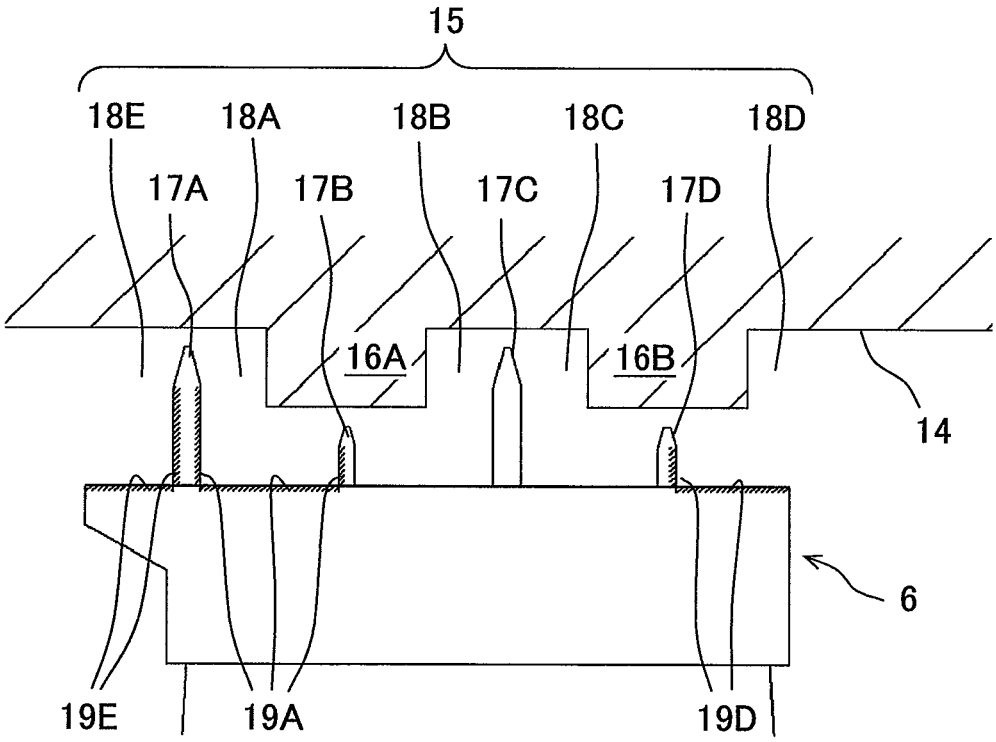
FIG. 6 is a partially enlarged sectional view illustrating a detailed structure of an interspatial flow passage in a third embodiment of the present invention.

FIG. 6 is a partially enlarged sectional view illustrating a detailed structure of an interspatial flow passage in the present embodiment. Elements in the present embodiment that are equivalent to those of the first embodiment are each assigned the same reference number, and description of these elements may be omitted where appropriate.

In the present embodiment, while the rough surface 19A in the seal-divided space 18A, the rough surface 19D in the seal-divided space 18D, and the rough surface 19E in the seal-divided space 18E are formed, the rough surface 19B in the seal-divided space 18B and the rough surface 19C in the seal-divided space 18C are not present.

As in much of the first embodiment (differences will be detailed later), in the third embodiment having the above configuration, the decrease rate of the circumferential velocity of the leakage steam in the interspatial flow passage 15 can be held down and unstable fluid force can also be controlled thereby. In addition, in the present embodiment, since a machining zone is smaller than that required in the first embodiment, a machining time can be correspondingly reduced.

Fluid analyses that the present inventors conducted for confirming the advantageous effects of the second and third embodiments will now be described. These embodiments employed the same interspatial flow passage model and analytical parameters as those which have been described in the first embodiment. The surface roughness of any one or more of the rough surfaces 19A to 19E formed in the second and third embodiments, however, was fixed at 200 μm. During the analyses, the rotating section and the stationary section were made eccentric relative to each other's center, and the spring constant 'k' was calculated.

Figure 7:
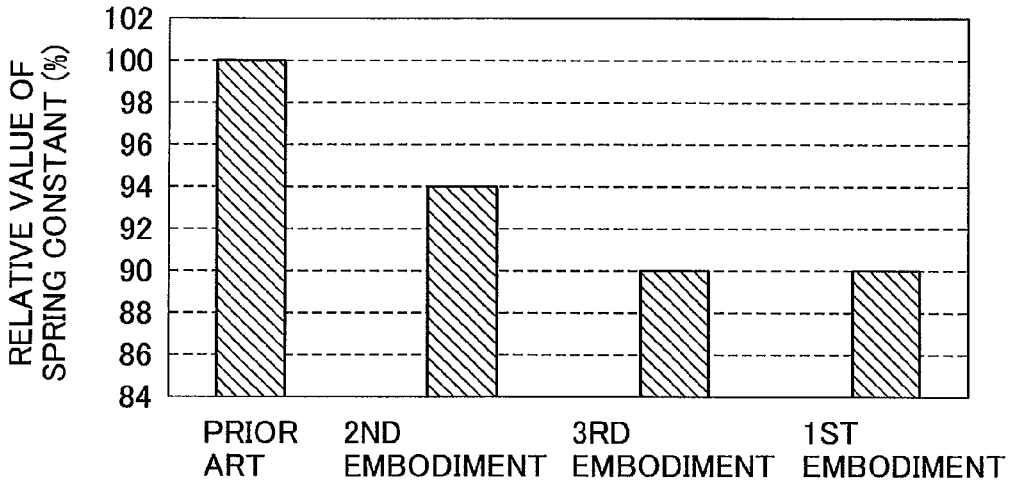
FIG. 7 is a diagram for describing advantageous effects of the second and third embodiments of the present invention by comparison between the first embodiment of the present invention and the conventional technique, the diagram being shown to represent differences in spring constant that were obtained as analytical results.

FIG. 7 is a diagram for describing the advantageous effects of the second and third embodiments of the present invention by comparison between the first embodiment of the present invention and the prior art, the diagram being shown to represent differences in the relative value of the spring constant that were obtained as numerical results. These relative values, as with the values shown in FIG. 4, are expressed for the reference spring constant of 100% in which the rough surfaces 19A to 19E are not formed as in the prior art.

As shown in FIG. 7, in the first embodiment where the rough surfaces 19A to 19E are respectively formed in the seal-divided spaces 18A to 18E, the spring constant decreases by nearly 10%. In the second embodiment where only the rough surface 19A in the seal-divided space 18A is formed, while the advantageous effects are less significant than in the first embodiment, the spring constant decreases by nearly 6%. In the third embodiment where only the rough surfaces 19A, 19D, and 19E in the seal-divided spaces 18A, 18D, and 18E are formed, the spring constant decreases by nearly 10% as in the first embodiment.

Figure 8:
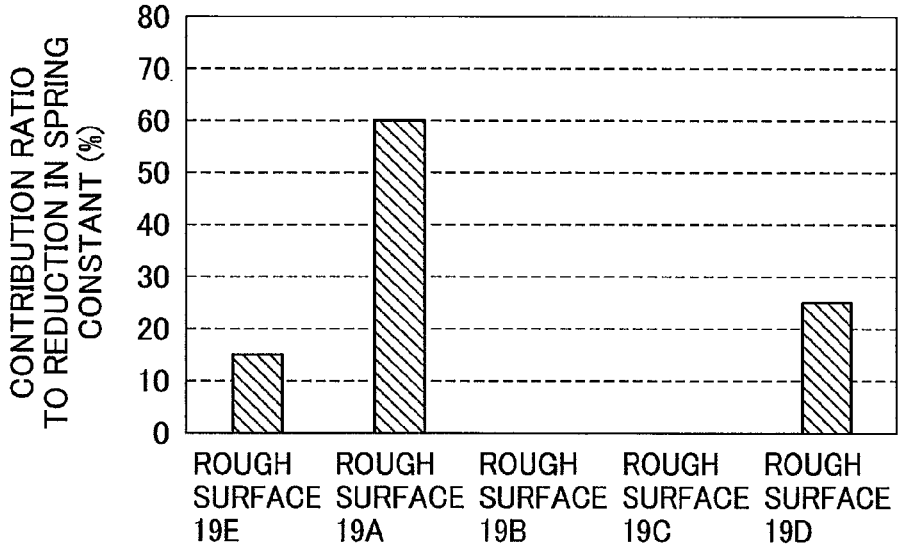
FIG. 8 represents contribution ratios of analytically obtained rough surfaces with respect to reduction in spring constant.

For the confirmation of the contribution ratios of rough surfaces to reduction in spring constant, the present inventors conducted further fluid analyses using a rough surface formation pattern different from that of the first to third embodiments, and then conducted regression analyses upon the fluid analytical results. FIG. 8 is a diagram that represents the contribution ratios of analytically obtained rough surfaces with respect to reduction in spring constant.

Figure 9:
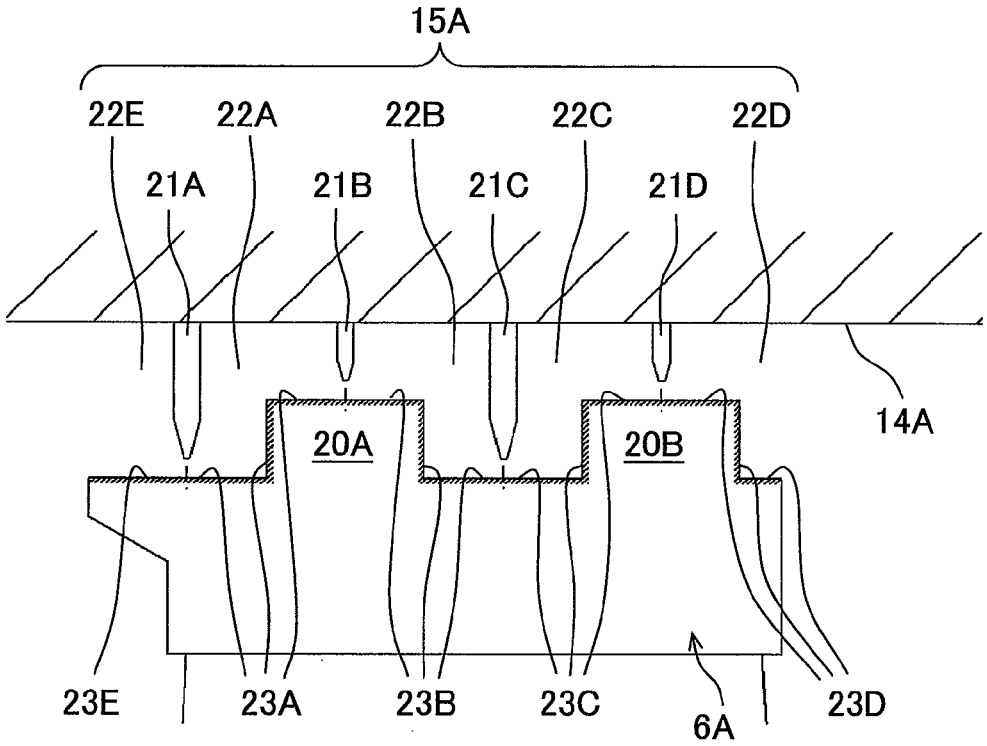
FIG. 9 is a partially enlarged sectional view illustrating a detailed structure of an interspatial flow passage in a fourth embodiment of the present invention.

As shown in FIG. 9, the contribution ratio of the rough surface 19A in the seal-divided space 18A is nearly 60%, which is the highest of all other rough surfaces contribution ratios. The contribution ratio of the rough surface 19D in the seal-divided space 18D is nearly 25%, and the contribution ratio of the rough surface 19A in the seal-divided space 18A is nearly 15%. In contrast to these values, the contribution ratio of the rough surface 19B in the seal-divided space 18B and that of the rough surface 19C in the seal-divided space 18C are nearly 0% (these contribution ratios are however likely to increase if the circumferential velocity at the inlet of the interspatial flow passage becomes higher).

The reasons why the analytical results described above were obtained would be that the circumferential velocity of the leakage steam flowing from the main flow passage 7 into the interspatial flow passage 15 is relatively high, the seal-divided space 18E is opened to a relatively large space at the upstream side of the seal-divided space 18E, and the seal-divided space 18D is opened to a relatively large space at the downstream side of the seal-divided space 18D. A further reason is that as shown earlier in FIG. 3, the effect of the rough surface 19A in the seal-divided space 18A, that is, the suppression effect on the decrease rate of the circumferential velocity of the leakage steam, becomes greatest. A still further reason is that the effect of the rough surface 19E in the seal-divided space 18E, that is, the suppression effect on the decrease rate of the circumferential velocity of the leakage steam, becomes relatively great. A yet further reason is that although conveniently not shown in FIG. 3, the effect of the rough surface 19D in the seal-divided space 18D, that is, the suppression effect on the decrease rate of the circumferential velocity of the leakage steam, becomes relatively great.

The present inventors studied the operational effects of the first and third embodiments further closely. The first embodiment and the third embodiment yield substantially the same reduction effect for the spring constant. The rough surfaces, however, act to lower the damping coefficient 'C' shown earlier in formula (1), as well as to reduce the spring constant 'k' shown therein. In the third embodiment, therefore, since the rough surface 19B in the seal-divided space 18B and the rough surface 19C in the seal-divided space 18C are not formed, decreases in damping coefficient can be correspondingly controlled relative to those of the first embodiment. This indicates that in comparison to the first embodiment, the third embodiment allows a smaller value in the right side of formula (1) and a higher stable effect against the whirling of the rotating section.

A fourth embodiment of the present invention will now be described with FIGS. 9 and 10.

FIG. 9 is a partially enlarged sectional view illustrating a detailed structure of an interspatial flow passage in the present embodiment.

A labyrinth seal at an interspatial flow passage 15A in the present embodiment includes two annular steps, 20A and 20B, on an outer circumferential side of a rotor blade cover 6A. On an inner circumferential surface of a grooved section 14A in a casing 1, four stages of sealing fins, 21A to 21D, are spatially arranged in a rotor axial direction.

The sealing fins 21A to 21D extend from the outer circumferential surface of the rotor blade cover 6A toward the inner circumferential surface of the grooved section 14A in the casing 1. The sealing fins 21B and 21D respectively extend toward the steps 20A and 20B, and are therefore shorter than the sealing fins 21A and 21C. An independent clearance reducing portion is formed between a distal end of each of the sealing fins 21A to 21D and the outer circumferential surface of the rotor blade cover 6A so as to perform a sealing function.

In addition, a seal-divided space 22A is defined by the sealing fin 21A of the first stage and the sealing fin 21B of the second stage, both as counted from an upstream side. Likewise, a seal-divided space 22B is defined by the sealing fin 21B of the second stage and the sealing fin 21C of the third stage; a seal-divided space 22C is defined by the sealing fin 21C of the third stage and the sealing fin 21D of the fourth stage; a seal-divided space 22D is defined downstream of the sealing fin 21D of the fourth stage; and a seal-divided space 22E is defined upstream of the sealing fin 21A of the first stage. The seal-divided spaces 22A to 22E constitute the interspatial flow passage 15A.

The present embodiment has an outstanding feature that a rotational friction enhancement portion is provided at the rotating section side in the interspatial flow passage 15A overall so as to extend entirely in a circumferential direction of the rotating section. More specifically, in the seal-divided space 22A, a rough surface 23A is formed in an entire circumferential direction of the outer circumferential surface of the rotor blade cover 6A (this outer circumferential surface includes an outer circumferential surface of the step 20A and an upstream side surface of this step). Additionally, in the seal-divided space 22B, a rough surface 23B is formed in the entire circumferential direction on the outer circumferential surface of the rotor blade cover 6A (more accurately, this outer circumferential surface includes the outer circumferential surface of the step 20A and a downstream side surface of this step). Furthermore, in the seal-divided space 22C, a rough surface 23C is formed in the entire circumferential direction of the outer circumferential surface of the rotor blade cover 6A (this outer circumferential surface includes an outer circumferential surface of the step 20B and an upstream side surface of this step). Moreover, in the seal-divided space 22D, a rough surface 23D is formed in the entire circumferential direction of the outer circumferential surface of the rotor blade cover 6A (this outer circumferential surface includes the outer circumferential surface of the step 20B and a downstream side surface of this step). In the seal-divided space 22E, a rough surface 23E is formed in the entire circumferential direction of the outer circumferential surface of the rotor blade cover 6A. The rough surfaces 23A to 23E constitute the rotational friction enhancement portion.

The rough surfaces 23A to 23E are formed by, for example, blast machining to ensure that they are rougher than the inner circumferential surface of the grooved section 14A in the casing 1, and more specifically, that their arithmetic mean surface roughness (Ra) becomes a predetermined value falling within a range of 50-200 μm.

In the present embodiment that has the above configuration as well, a decrease rate of a circumferential velocity of leakage steam in the interspatial flow passage 15A can be held down. This in turn enables unstable fluid force to be controlled.

Fluid analyses that the present inventors conducted for confirming the advantageous effects of the present embodiment will now be described. An interspatial flow passage model substantially of the same structure as that of the interspatial flow passage 15A in the embodiment was employed. As in the first embodiment, the analyses were conducted under the conditions of 11.82 MPa in pressure of interspatial flow passage inlet, 708 K in temperature of the same, 190 m/s in circumferential velocity of the same, 10.42 MPa in pressure of interspatial flow passage outlet, 55 mm in interspatial flow passage length, and 0.8 mm in the dimension of the clearance reducing portion. In addition, surface roughness of a stationary section side (this surface roughness is equivalent to that of the inner circumferential surface of the grooved section 14A in the casing 1 and to that of the sealing fins 21A to 21D) was taken as zero, and surface roughness of a rotating section side (this surface roughness is equivalent to that of the rough surfaces 23A to 23E) was changed within the range of 0-200 μm with respect to the above reference. During the analyses, the rotating section and the stationary section were made eccentric relative to each other's center, and the spring constant 'k' earlier shown in formula (1) was calculated.

Figure 10:
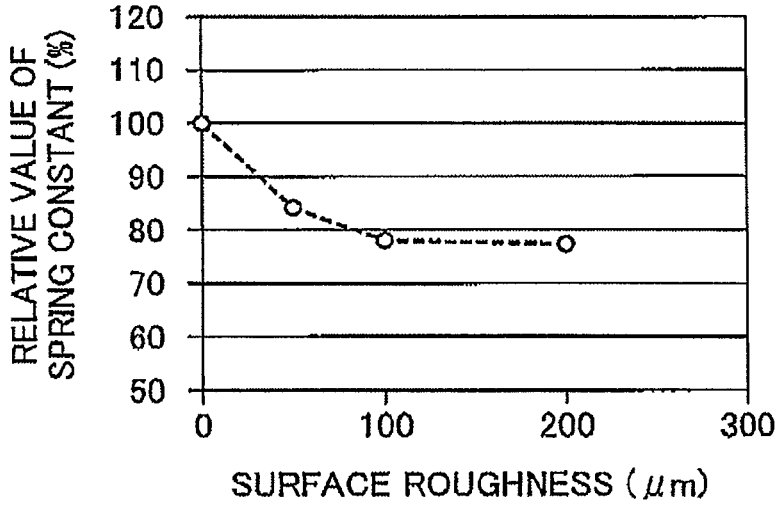
FIG. 10 is a diagram for describing advantageous effects of the fourth embodiment of the present invention, the diagram representing a relationship between surface roughness of a rotating section side of the interspatial flow passage and a spring constant.

FIG. 10 represents a relationship between surface roughness of the rotating section side of the interspatial flow passage and the spring constant, the relationship being obtained as a fluid analytical result. In FIG. 10, changes in the surface roughness of the rotating section side are plotted along a horizontal axis, and changes in a relative value of the spring constant, expressed for a reference spring constant of 100% in which the surface roughness of the rotating section side was taken as zero (in other words, the rough surfaces 23A to 23E are not formed as in the prior art), are plotted along a vertical axis.

It can be appreciated from the fluid analytical result in FIG. 10 that the spring constant decreases as the surface roughness of the rough surfaces 23A to 23E is increased so as to be greater than that of the inner circumferential surface of the grooved section 14A in the casing 1. More specifically, when the surface roughness of the rough surfaces 23A to 23E is increased to 50 μm, the spring constant decreases by nearly 16%. When the surface roughness of the rough surfaces 23A to 23E is further increased to 100 μm, the spring constant decreases by nearly 22%. When the surface roughness of the rough surfaces 23A to 23E is further increased to 200 μm, the spring constant decreases by nearly 23%. These results indicate that the unstable fluid force can be controlled.

An example of forming the rough surfaces 23A to 23E in the seal-divided spaces 22A to 22E in a manner similar to that of the rough surface formation pattern used in the first embodiment has been described in the fourth embodiment. However, this example does not limit the rough surface formation patterns usable in the present invention. That is to say, only the rough surface 23A in the seal-divided space 22A may be formed similarly to the rough surface formation pattern used in the second embodiment. On top of that, only the rough surfaces 23A, 23D, and 23E in the seal-divided spaces 22A, 22D, and 22E may be respectively formed similarly to the rough surface formation pattern used in the third embodiment. In these cases as well, the above-described effects will be obtained.

In addition, while an example of configuring the rotational friction enhancement portion formed with the rough surfaces having roughness of 50-200 μm has been described in each of the first to fourth embodiments, this example is not limitative and the present invention can be modified in various forms without departing from the scope and technical idea of the invention. The following elaborates some of those modifications.

Figure 11:
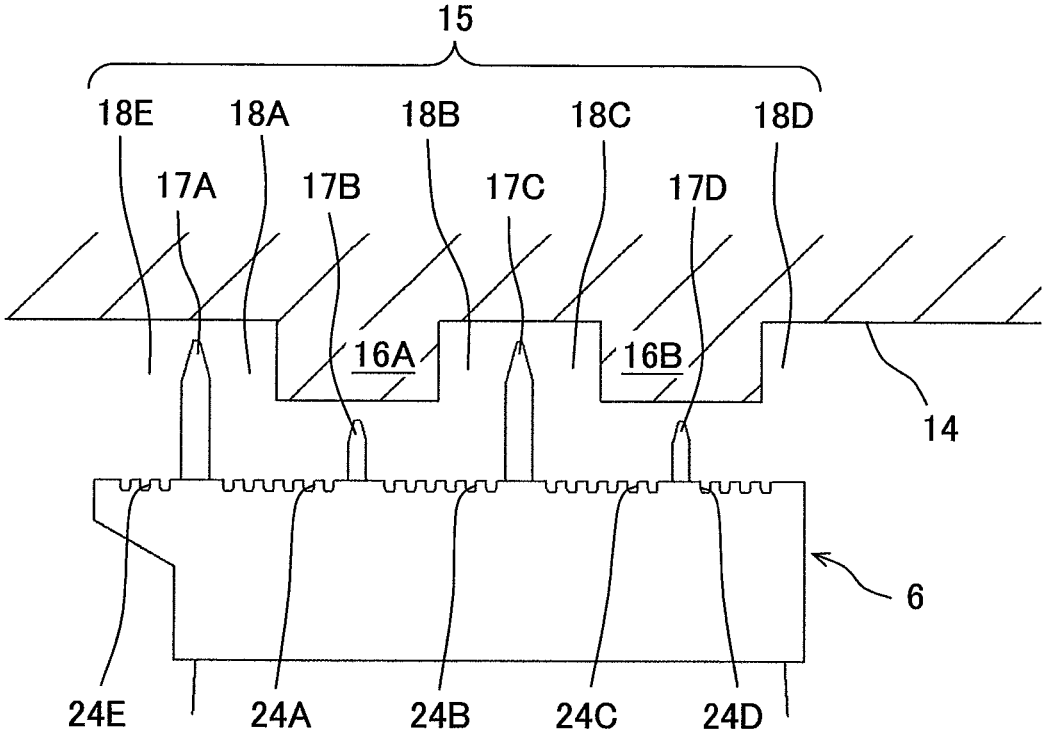
FIG. 11 is a partially enlarged sectional view illustrating a detailed structure of an interspatial flow passage in a first modification of the present invention.

As in a first modification that FIG. 11 shows, the rotational friction enhancement portion may be configured by annular surface recesses. In this modification, six annular surface recesses, 24A, are formed on the outer circumferential surface of the rotor blade cover 6 in the seal-divided space 18A. Six annular surface recesses, 24B, are formed on the outer circumferential surface of the rotor blade cover 6 in the seal-divided space 18B. Six annular surface recesses, 24C, are formed on the outer circumferential surface of the rotor blade cover 6 in the seal-divided space 18C. Four annular surface recesses, 24D, are formed on the outer circumferential surface of the rotor blade cover 6 in the seal-divided space 18D. Three annular surface recesses, 24E, are formed on the outer circumferential surface of the rotor blade cover 6 in the seal-divided space 18E.

The surface recesses 24A to 24E are formed by, for example, cutting to ensure that they are at least 0.1 mm deep and have a height equal to or less than half that of a sealing fin (more specifically, the height of the smallest sealing fins 17B and 17D in the labyrinth seal). With these surface recesses 24A to 24E, the outer circumferential surface of the rotor blade cover 6 can be increased in surface area for enhanced circumferential shear force. The depth of at least 0.1 mm of the surface recesses 24A to 24E has been defined for preventing these recesses from being buried under a velocity boundary layer of the fluid flow and thus avoiding a reduction in the effect of enhancing a circumferential shear force.

An example of forming the surface recesses 24A to 24E in the seal-divided spaces 18A to 18E in a manner similar to that of the rough surface formation pattern used in the first embodiment has been described in the first modification. However, this example does not limit the rough surface formation patterns usable in the present invention. That is to say, only the surface recess 24A in the seal-divided space 18A may be formed similarly to the rough surface formation pattern used in the second embodiment. On top of that, only the surface recesses 24A, 24D, and 24E in the seal-divided spaces 18A, 18D, and 18E may be respectively formed similarly to the rough surface formation pattern used in the third embodiment. Moreover, the surface recesses 24A to 24E may be applied to a structure with sealing fins at the stationary section side as in the fourth embodiment. In these cases as well, the above-described effects will be obtained.

Figure 12:
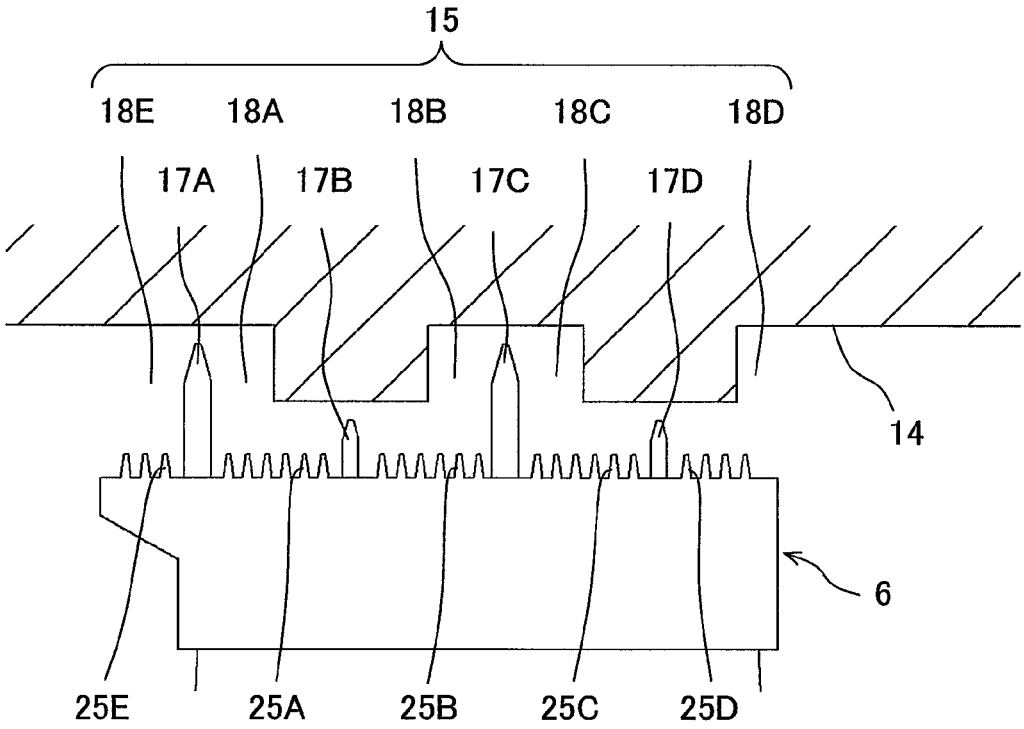
FIG. 12 is a partially enlarged sectional view illustrating a detailed structure of an interspatial flow passage in a second modification of the present invention.

In addition, as in a second modification that FIG. 12 shows, the rotational friction enhancement portion may be configured by annular surface bumps. In this modification, six annular surface bumps, 25A, are formed on the outer circumferential surface of the rotor blade cover 6 in the seal-divided space 18A. Six annular surface bumps, 25B, are formed on the outer circumferential surface of the rotor blade cover 6 in the seal-divided space 18B. Six annular surface bumps, 25C, are formed on the outer circumferential surface of the rotor blade cover 6 in the seal-divided space 18C. Four annular surface bumps, 25D, are formed on the outer circumferential surface of the rotor blade cover 6 in the seal-divided space 18D. Three annular surface bumps, 25E, are formed on the outer circumferential surface of the rotor blade cover 6 in the seal-divided space 18E.

The surface bumps 25A to 25E are formed by, for example, their integral cutting with the rotor blade cover 6 to ensure that they are at least 0.1 mm deep and have a height equal to or less than half that of a sealing fin (more specifically, the height of the smallest sealing fins 17B and 17D in the labyrinth seal). In other words, a clearance reducing portion is not formed between a distal end of each of the surface bumps 25A to 25E and the inner circumferential surface of the grooved section 14 so as to not perform a sealing function. With the surface bumps 25A to 25E, the outer circumferential surface of the rotor blade cover 6 can be increased in surface area for enhanced circumferential shear force. The depth of at least 0.1 mm of the surface bumps 25A to 25E has been defined for preventing these bumps from being buried under the velocity boundary layer of the fluid flow and thus avoiding a reduction in the effect of enhancing a circumferential shear force.

An example of forming the surface bumps 25A to 25E in the seal-divided spaces 18A to 18E in a manner similar to that of the rough surface formation pattern used in the first embodiment has been described in the second modification. However, this example does not limit the rough surface formation patterns usable in the present invention. That is to say, only the surface bump 25A in the seal-divided space 18A may be formed similarly to the rough surface formation pattern used in the second embodiment. On top of that, only the surface bumps 25A, 25D, and 25E in the seal-divided spaces 18A, 18D, and 18E may be respectively formed similarly to the rough surface formation pattern used in the third embodiment. Moreover, the surface bumps 25A to 25E may be applied to a structure with sealing fins at the stationary section side as in the fourth embodiment. In these cases as well, the above-described effects can be obtained.

Figure 13:
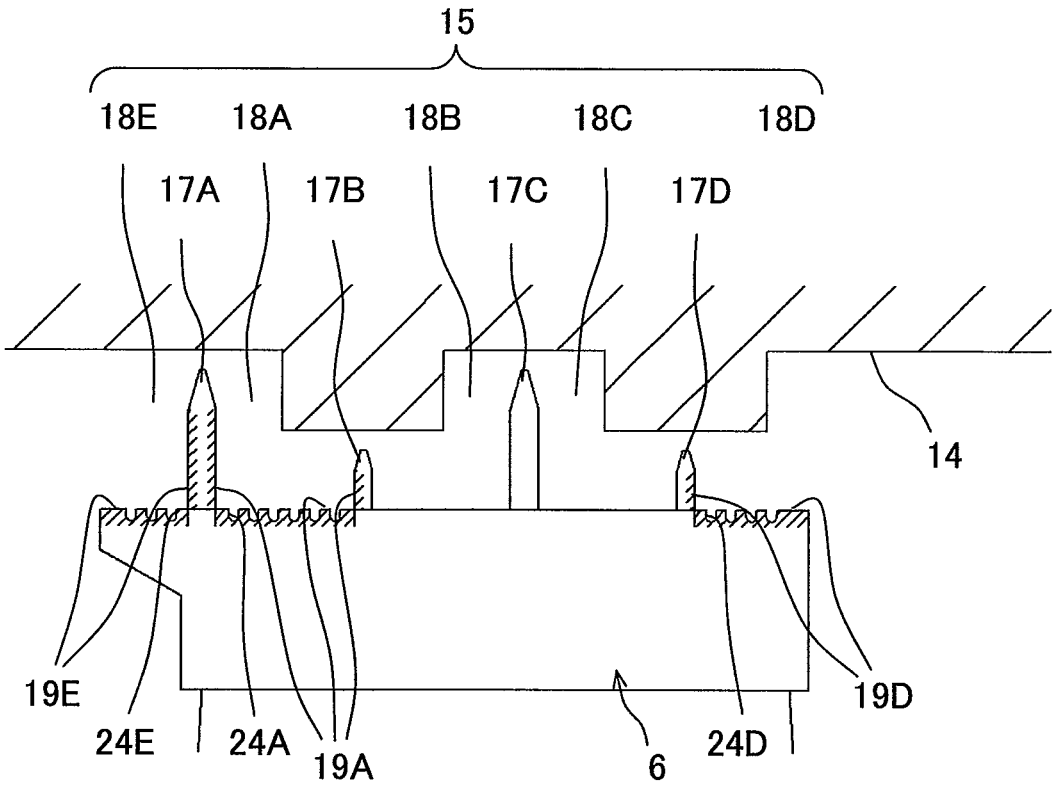
FIG. 13 is a partially enlarged sectional view illustrating a detailed structure of an interspatial flow passage in a third modification of the present invention.
Figure 14:
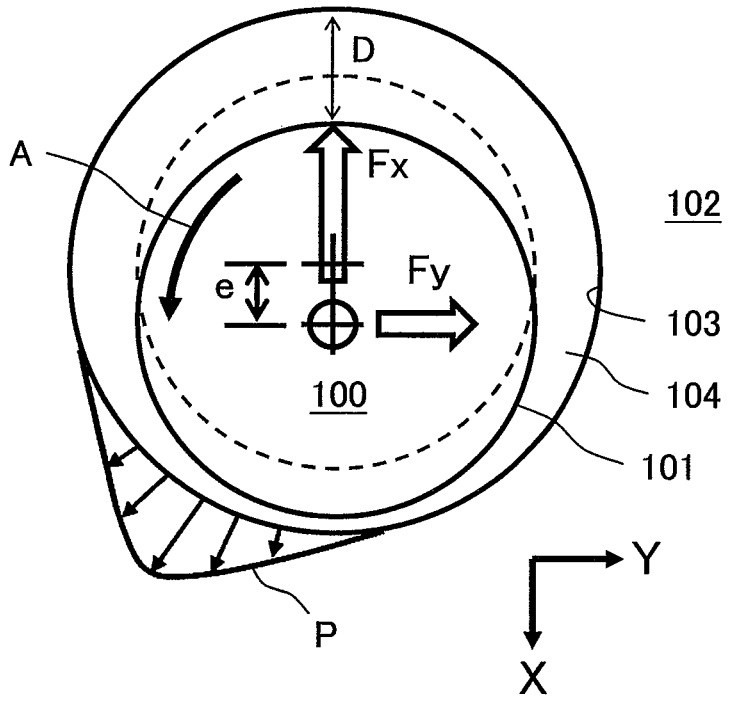
FIG. 14 is a schematic sectional view of an interspatial flow passage taken along a radial direction of a rotor to describe a fluid force component that causes unstable vibration.
Figure 15:
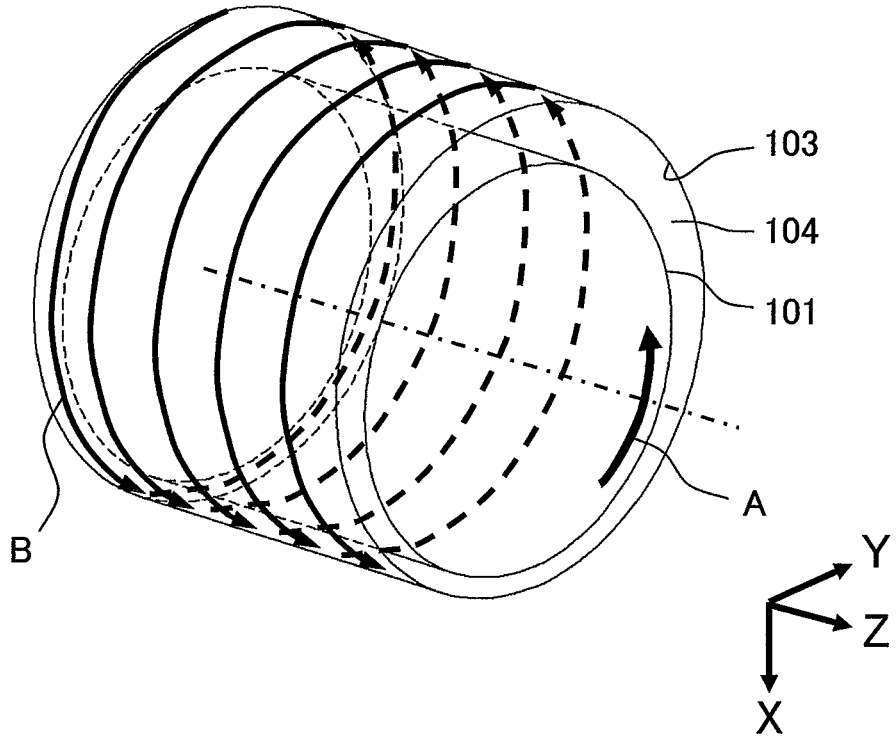
FIG. 15 is a schematic perspective view of the interspatial flow passage to describe a spiral flow of the fluid in the interspatial flow passage.
Figure 16:
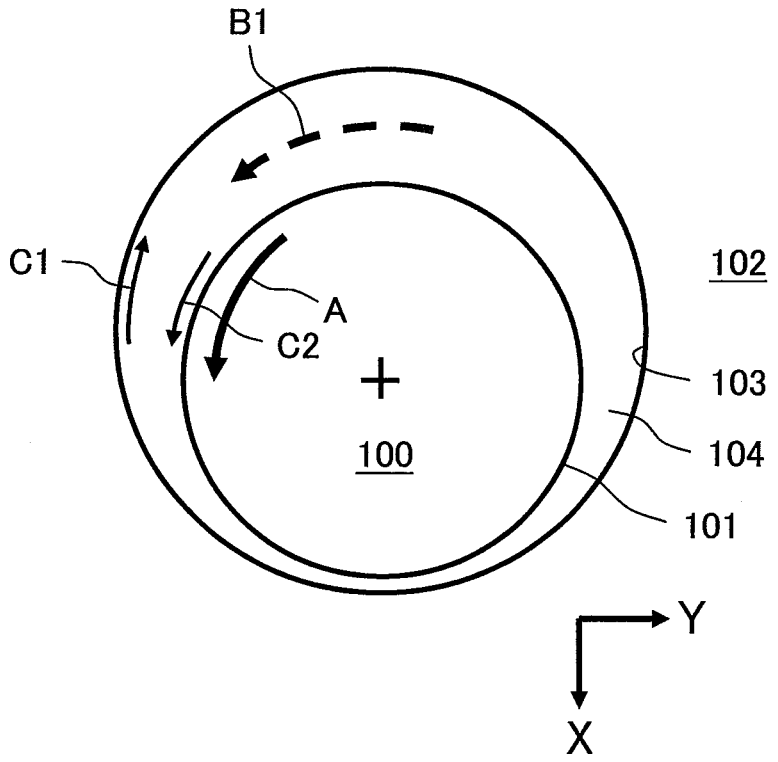
FIG. 16 is a schematic sectional view of the interspatial flow passage taken along the radial direction of the rotor to describe a circumferential shear force occurring in the interspatial flow passage.

For example, any one or more of the first embodiment, the first modification, and the second modification may be combined. Furthermore, the rough surface formation pattern in the first embodiment may be replaced by that of the second embodiment or by that of the third embodiment (i.e., a third modification shown as a more specific example in FIG. 13). In these cases as well, the above-described effects will be obtained.

Moreover, although an example of disposing two annular steps at one of the rotating section side and the stationary section side and four stages of annular sealing fins at the other of the rotating section side and the stationary section side has been described in the labyrinth seal in each of the embodiments and the modifications, this example is not limitative and the present invention can be modified in various forms without departing from the scope and technical idea of the invention. That is to say, at least three stages of annular sealing fins may instead be disposed and the number and layout of sealing fins may be changed. The number and layout of steps may also be changed or no steps may need to be disposed.

While a steam turbine that is one kind of axial-flow turbine has been described above an example of application of the present invention, this example is not limitative and the invention may be applied to gas turbines or other types. The invention may also be applied to other rotating fluid machines. In these cases as well, substantially the same advantageous effects as those described above will be obtained.

DESCRIPTION OF REFERENCE NUMBERS

1 Casing
2 Rotor
3 Stator vane cascade
4 Rotor blade cascade
5 Stator vane cover
6, 6A Rotor blade covers
14, 14A Grooved sections
15, 15A Interspatial flow passages
17A to 17E Sealing fins
18A to 18E Seal-divided spaces
19A to 19E Rough surfaces
21A to 21E Sealing fins
22A to 22E Seal-divided spaces
23A to 23E Rough surfaces
24A to 24E Surface recesses
25A to 25E Surface bumps

The invention claimed is:

1. A rotating fluid machine comprising:

an interspatial flow passage formed between an outer circumferential surface of a rotating section and an inner circumferential surface of a stationary section;

at least three stages of annular sealing fins arranged at the rotating section side or stationary section side in the interspatial flow passage, the annular sealing fins being spaced apart in a direction of a rotational axis; and a friction enhancement portion disposed on the rotating section side in the interspatial flow passage so as to extend entirely in a circumferential direction of the rotating section, wherein the interspatial flow passage includes:

a first seal-divided space defined by the sealing fin of a first stage, disposed at a most upstream side of all the sealing fins, and the sealing fin of an intermediate stage, a second seal-divided space defined by the sealing fin of the intermediate stage and the sealing fin of a final stage, disposed at a most downstream side of all the sealing fins, a third seal-divided space defined downstream of the sealing fin of the final stage, and a fourth seal-divided space defined upstream of the sealing fin of the first stage, and wherein the friction enhancement portion is disposed on the rotating section side in the first seal-divided space so as to extend entirely in the circumferential direction of the rotating section, and is not disposed in the second seal-divided space.

2. The rotating fluid machine according to claim 1, wherein the friction enhancement portion is further disposed on the rotating section side in the third seal-divided space and the fourth seal-divided space so as to extend entirely in the circumferential direction of the rotating section.

3. The rotating fluid machine according to claim 1, wherein the friction enhancement portion is configured by a rough surface having roughness of 50-200 μm.

4. The rotating fluid machine according to claim 1, wherein the friction enhancement portion is configured by an annular surface recess formed on the outer circumferential surface of the rotating section so as to be at least 0.1 mm deep, have a height equal to or less than half that of the sealing fins, and include at least three segments for each space divided by the sealing fins.

5. The rotating fluid machine according to claim 1, wherein the friction enhancement portion is configured by an annular surface bump formed on the outer circumferential surface of the rotating section so as to be at least 0.1 mm deep, have a height equal to or less than half that of the sealing fins, and include at least three segments for each space divided by the sealing fins.

6. The rotating fluid machine according to claim 1, further comprising:

a casing;

a rotor rotatably disposed inside the casing;

a stator vane cascade disposed at an inner circumferential side of the casing;

a rotor blade cascade provided at an outer circumferential side of the rotor and disposed at an axial downstream side of the rotor with respect to the stator vane cascade;

an annular rotor blade cover disposed at an outer circumferential side of the rotor blade cascade; and an annularly grooved section formed at the inner circumferential side of the casing and storing the rotor blade cover, wherein the interspatial flow passage is formed between an outer circumferential surface of the rotor blade cover and an inner circumferential surface of the grooved section in the casing.

* * * * *